US011230852B2

(12) United States Patent
Uetabira et al.

(10) Patent No.: US 11,230,852 B2
(45) Date of Patent: Jan. 25, 2022

(54) MOBILE TERMINAL BOOTH WITH SOUND MASKING FUNCTION

(71) Applicant: INTERMAN Corporation, Kagoshima (JP)

(72) Inventors: Shigeki Uetabira, Kagoshima (JP); Junichi Nakamura, Tokyo (JP)

(73) Assignee: INTERMAN Corporation, Kagoshima (JP)

( * ) Notice: Subject to any disclaimer, the term of this patent is extended or adjusted under 35 U.S.C. 154(b) by 25 days.

(21) Appl. No.: 16/928,286

(22) Filed: Jul. 14, 2020

(65) Prior Publication Data

US 2020/0370318 A1 Nov. 26, 2020

(51) Int. Cl.
*E04H 1/12* (2006.01)
*G10K 11/175* (2006.01)

(52) U.S. Cl.
CPC ..... *E04H 1/1205* (2013.01); *G10K 11/1752* (2020.05)

(58) Field of Classification Search
CPC ..... E04H 1/1205; G10K 11/1752
See application file for complete search history.

(56) References Cited

U.S. PATENT DOCUMENTS 2,328,618 A * 9/1943 Corso ..... E04H 1/14 52/262
2,337,885 A * 12/1943 Hallam ..... E04H 1/14 52/28
2,397,606 A * 4/1946 Hoyle ..... E04H 1/14 52/145
2,397,609 A * 4/1946 Leadbetter ..... E04H 1/14 52/145
3,728,801 A * 4/1973 Beckman ..... G09B 5/067 434/314
3,869,992 A * 3/1975 Kramer ..... G09B 5/02 108/60

(Continued)

FOREIGN PATENT DOCUMENTS

EP 2367169 A2 * 9/2011 ..... H04K 3/45
JP H08-296335 A 11/1996

(Continued)

OTHER PUBLICATIONS

International Search Report dated Dec. 15, 2020, in connection with corresponding International Application No. PCT/JP2020/038407 (11 pp., including machine-generated English translation).

(Continued)

*Primary Examiner* — David L Ton
(74) *Attorney, Agent, or Firm* — Maier & Maier, PLLC

(57) ABSTRACT

A mobile terminal booth with a sound masking function includes a sound absorbing panel which partitions a space as viewed from the above to provide a place where a user of a mobile terminal can have a telephone conversation; a speaker provided to emit sounds to an outside of the mobile terminal booth; and a masking sound generation unit provided to emit a masking sound through the speaker. The harsh-sounding high frequency components of the masking sound which is output from the speaker are attenuated so that the masking sound gives less uncomfortable feeling to persons surrounding the mobile terminal booth.

4 Claims, 6 Drawing Sheets

(56) References Cited

U.S. PATENT DOCUMENTS

| | | | | |
|---|---|---|---|---|
| 5,182,883 | A * | 2/1993 | Amberson | E04H 1/14 52/27 |
| 2011/0182438 | A1 | 7/2011 | Koike et al. | |
| 2013/0163778 | A1 | 6/2013 | Ito et al. | |
| 2014/0033620 | A1 | 2/2014 | Uetabira | |
| 2015/0055790 | A1* | 2/2015 | Kawakami | G10K 11/17857 381/73.1 |
| 2016/0160498 | A1* | 6/2016 | Uetabira | E04B 1/8218 181/198 |
| 2016/0199241 | A1 | 7/2016 | Rapoport | |
| 2016/0277834 | A1 | 9/2016 | Hata et al. | |

FOREIGN PATENT DOCUMENTS

| | | | |
|---|---|---|---|
| JP | 2006-267174 | A | 10/2006 |
| JP | 2011-154141 | A | 8/2011 |
| JP | 2012-073411 | A | 4/2012 |
| JP | 2012-113130 | A | 6/2012 |
| JP | 2012-194415 | A | 10/2012 |
| JP | 2013-134270 | A | 7/2013 |
| JP | 2013-231931 | A | 11/2013 |
| JP | 2014-43765 | A | 3/2014 |
| JP | 2014-199445 | A | 10/2014 |
| JP | 2016-177204 | A | 10/2016 |
| JP | 2016-534835 | A | 11/2016 |
| JP | 2018-136940 | A | 8/2018 |

OTHER PUBLICATIONS

Written Opinion dated Dec. 15, 2020, in connection with corresponding International Application No. PCT/JP2020/038407 (10 pp., including machine-generated English translation).

* cited by examiner

MOBILE TERMINAL BOOTH WITH SOUND MASKING FUNCTION

CROSS-REFERENCE TO RELATED APPLICATIONS

Japanese Patent Application No. 2019-096753 filed on May 23, 2019 including description, claims, drawings, and abstract the entire disclosure is incorporated herein by reference herein in its entirely.

BACKGROUND OF THE INVENTION

Field of the Invention

The present invention relates to a mobile terminal booth with a sound masking function for providing an area where a mobile terminal can be comfortably used in a public area or the like.

Description of Related Art

Currently, the penetration rate of cellular phones and smartphones has exceeded 100 percent of the Japanese population, and almost all the Japanese have communication devices at all times. Such mobile terminals are convenient to make it possible to collect and transmit information or have telephone conversations, for example, by using spare time effectively on the move. In fact, a significant proportion of people in a park, a building, a street or the like public area are using mobile terminals for some purposes.

However, when a person has a telephone conversation on the move with a mobile terminal, it is common that the person talks beside other passengers, unlike having a telephone conversation with a public phone in a telephone booth. Accordingly, it is often difficult to hear the other person's voice in loud places, e.g., in a crowded street.

Even in a station yard or in a building, noise tends to be reverberating in the enclosed space so that it is sometimes difficult to talk in a relaxed way. Usually, when having a telephone conversation, a person moves close to a wall or the like where noise seems to be somewhat smaller. The noise level near a wall, however, is never small because of reverberating sound reflected from the wall. The reverberating sound often makes it difficult also for the person at the other end to hear the voice.

Taking into consideration the above circumstances, the present applicant has filed a Japanese patent application (Japanese Patent Published Application No. 2014-43765) in which a mobile terminal booth is proposed to improve convenience for users of mobile terminals. In accordance with this mobile terminal booth, for example, if the mobile terminal booth is installed in a lobby of a hotel, it is expected that guests can comfortably use mobile terminals, and manners are improved to make better the atmosphere in the hotel.

On the other hand, when a cellular phone is used to make conversation, there is the possibility that the content of conversation is heard by surrounding persons so that it is difficult to talk on a cellular phone about private content. While leak of conversation around can be suppressed to some extent by the use of the mobile terminal booth, there is some concern that the conversation is still heard by surrounding persons in a relatively quiet environment. Particularly, this concern becomes large in a building or an office.

On the other hand, noise masking systems are known (for example, as described in Japanese Patent Published Application No. 2006-267174) with which it becomes hard to hear sound information by outputting wideband noise (masking sound) on the basis of an auditory masking phenomenon. The noise masking effect of such a noise masking system is increased by turning up the volume of the masking sound. However, since the masking sound is a noise, it is desirable for persons, who are continuously hearing the noise, to minimize the volume of the masking sound as small as possible.

It is therefore an object of the present invention to provide a mobile terminal booth with a noise masking system which causes less uncomfortable feeling by masking sound.

SUMMARY OF THE INVENTION

To achieve at least one of the above-mentioned objects, reflecting one aspect of the present invention, a mobile terminal booth with a sound masking function comprises: a sound absorbing panel which partitions a space as viewed from the above to provide a place where a user of a mobile terminal can have a telephone conversation; a speaker provided to emit sounds to an outside of the mobile terminal booth; and a masking sound generation unit provided to emit a masking sound through the speaker, wherein a high frequency component of the masking sound is attenuated.

In accordance with the mobile terminal booth with a sound masking function of the present invention as described above, it is preferred that the masking sound is generated by attenuating a high frequency component of a raw sound material including a natural sound.

Furthermore, in accordance with the mobile terminal booth with a sound masking function of the present invention as described above, it is preferred that a human detection sensor is provided which detects a user entering the mobile terminal booth, wherein when the human detection sensor detects a user entering the mobile terminal booth, the masking sound is emitted from the speaker.

Still further, in accordance with the mobile terminal booth with a sound masking function of the present invention as described above, it is preferred that when the human detection sensor detects a user entering the mobile terminal booth, a BGM is emitted from the speaker, and then the masking sound is emitted from the speaker to overlap the BGM.

BRIEF DESCRIPTION OF THE DRAWINGS

The objects and features of the present invention will become more apparent from consideration of the following detailed description taken in conjunction with the accompanying drawings in which.

DETAILED DESCRIPTION OF THE PREFERRED EMBODIMENT

In what follows, a mobile terminal booth with sound masking function in accordance with an embodiment of the present invention will be explained with reference to the accompanying drawings. This mobile terminal booth can be installed inside a building such as a hotel, an office building or the like. When making a call, a user of a cellular phone can get away from reverberating sound by entering this mobile terminal booth to have telephone conversation. It is also possible to have conversation while preventing content of the conversation from being heard by others nearby. Furthermore, the user can use a cellular phone without worrying about other people who might be looking at the user.

Figure 1:
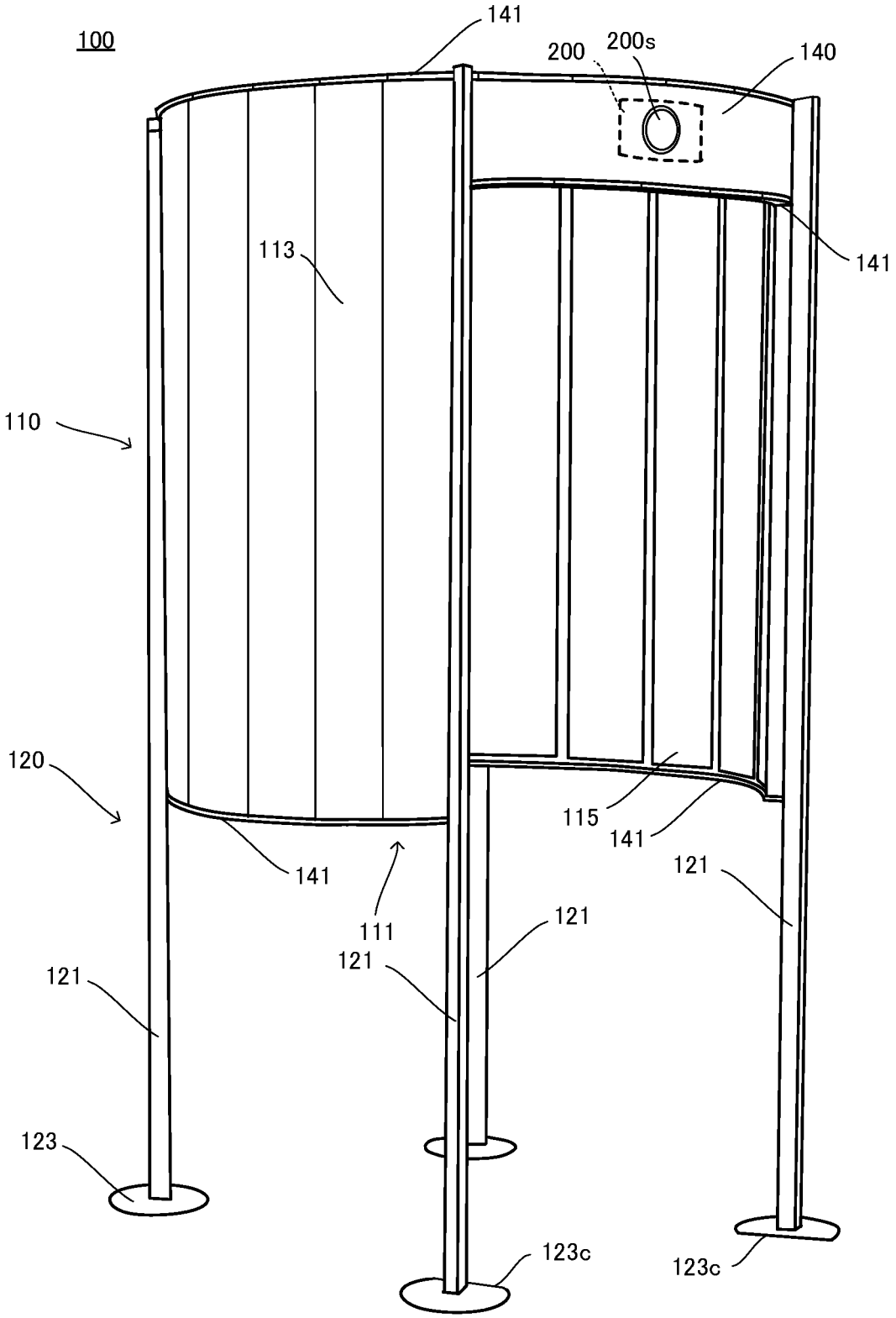
FIG. 1 is a perspective view for showing a mobile terminal booth in accordance with an embodiment of the present invention.

FIG. 1 is a perspective view for showing a mobile terminal booth in accordance with the embodiment of the present invention. This mobile terminal booth 100 includes a sound absorbing unit 110 in the form of a cylinder having a front opening, and a support frame 120 for supporting the sound absorbing unit 110. Each of them can be carried as several constituent parts and assembled in an installation site.

The sound absorbing unit 110 can be assembled by connecting a number of plate-like sound absorbing panels 111 in the form of an arch in a plan view. Each sound absorbing panel is, for example, 120 cm wide, 60 cm high and 3 cm thick. Also, the support frame 120 includes four pipes (support posts) to be vertically connected to the sound absorbing unit 110, and adjuster foots 123 made of steel and attached to the bottom surfaces of the pipes 121.

The adjuster foot 123 is a disclike plate, part of which is cut off along the entrance in the front side of the sound absorbing unit 110. This cut-off part 123*c* is provided for avoiding interference with a wheel of a wheel chair which is entering the mobile terminal booth 100.

If the length of the pipes 121 is 210 cm, the lower end of the sound absorbing unit 110 is located 90 cm from the floor. The sound absorbing unit 110 is effective when it is slightly taller than the position of the ears of the user. Generally speaking, the upper end of the plate-like sound absorbing panel 111 is located 10 to 15 cm higher than the average height of the country where the mobile terminal booth 100 is installed. The diameter of the sound absorbing unit 110 is 1 m to 1.5 m, for example, 1.2 m. While it is basically suggested to use the mobile terminal booth 100 by one person, the size is such as to accommodate two persons.

The plate-like sound absorbing panel 111 is assembled by mounting a sound absorbing member 115 on an aluminum panel. After mounting the sound absorbing member 115 on the aluminum panel 113, panel caps 141 are fitted onto the top and bottom ends of the aluminum panel 113. Also, as illustrated in the figure, the plate-like sound absorbing panels 111 are connected to each other in the form of a cylinder having an opening in the front side. Furthermore, a fascia 140 is provided above this opening in order to connect the plate-like sound absorbing panel 111 on the both side of the opening. In this case, the angle subtended by the opening and as seen from the center of the cylinder is 90 to 120 degrees, i.e., ¼ to ⅓ of the circumference.

Figure 2:
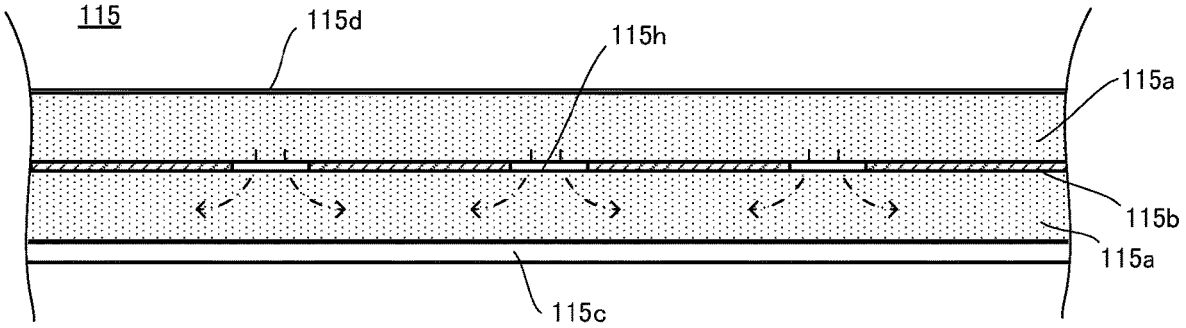
FIG. 2 is an exploded perspective view for showing the structure of the plate-like sound absorbing panel in accordance with the embodiment 1 of the present invention.

The sound absorbing member 115 has a sound absorbing structure as illustrated in FIG. 2. The sound absorbing structure includes a pair of sound absorbing sheets 115*a* bonded as a laminate together with an intervening thin vinyl film 115*b* (resin sheet) therebetween. The vinyl film 115*b* functions as a sound scattering. The sound absorbing sheet 115*a* is made of a needle felt which functions as a sound absorbing material. Other sound absorbing material includes glass wool, thermo wool, bestray, softray, phenol resin, and polyurethane. The thickness of the sound absorbing sheet 115*a* is for example 1 to 2 cm, and the thickness of the vinyl film 115*b* is for example 0.1 mm through 0.5 mm. Furthermore, the back side of the sound absorbing member 115 is covered by a soft polyvinyl chloride plate 105*c*. Also, the other inner side is covered with a cloth 115*d*. The total thickness of the sound absorbing member 115 is thereby about 2 to 4 cm.

Figure 3:
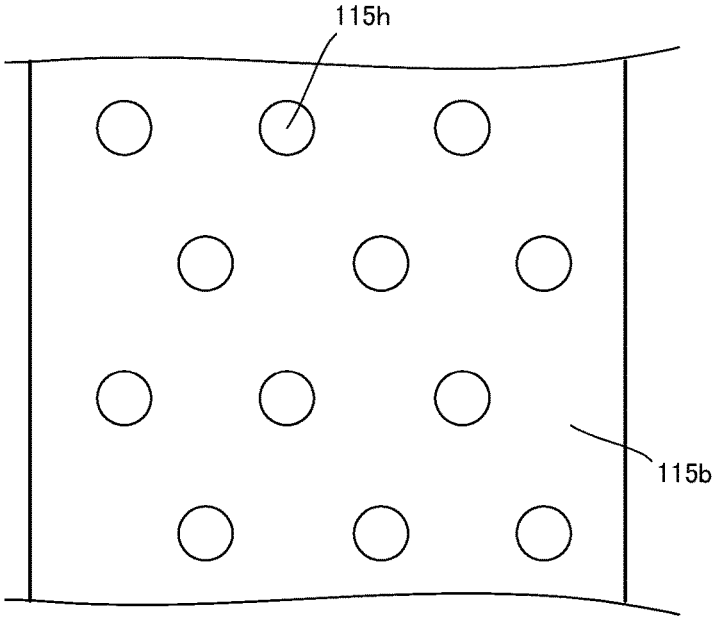
FIG. 3 is a plan view for showing openings opened through a vinyl film which is inserted between the sound absorbing member shown in FIG. 2.

As illustrated in FIG. 3, the vinyl film 115*b* is provided with a number of openings 115*h*. For example, the diameter of each opening 115*h* is 2 cm, and adjacent ones thereof are located 7 cm distant from each other. With the openings 115*h*, the incident sound waves can be effectively scattered in the lateral direction to enhance the sound absorbing capabilities of the sound absorbing sheet 115*a*. In addition, the openings 115*h* allow part of the incident sound waves to pass through the vinyl film 115*b* to control the balance between reflection and transmission, such that they functions as a sound controlling means.

The vinyl film 115*b* and the sound absorbing sheets 115*a* are joined with a viscous adhesive. The viscous adhesive is applied also between the sound absorbing sheets 115*a* through the openings 115*h*. While maintaining a certain viscosity, this viscous adhesive intervenes between the vinyl film 115*b* and the sound absorbing sheet 115*a* with a certain viscosity being maintained. Also, while maintaining a certain viscosity, this viscous adhesive intervenes between the sound absorbing sheets 115*a* through the openings 115*h*. In other words, it is important that, even when the sound absorbing member 115 is used, the viscous adhesive shall not entirely be solidified but can maintain its slimy state.

Such a sound absorption structure is characterized by capability of absorbing incident sound waves in a wide range from very low frequencies to very high frequencies. Particularly, with respect to the purpose of the present invention, it is important that the sound absorbing structure can substantially dump sound pressure levels at 500 Hz or higher frequencies which phone users feels noisy. On the other hand, it is considered difficult to maintain sound absorbing capabilities at low frequencies. However, even with the sound absorption structure as described above, the sound absorbing capability in low frequency bands is still low in comparison with in high frequency bands.

The mobile terminal booth according to the present invention is provided with a masking sound generation unit. In the case of this embodiment, the masking sound generation unit 200 is implemented within the fascia 140. This masking sound generation unit 200 is a device which emits a masking sound from a speaker 200*s* to make sound information of voices in the mobile terminal booth less audible. Also, this masking sound generation unit 200 is provided with a microphone, which is not shown in the figure, for collecting sounds inside the mobile terminal booth. Furthermore, this masking sound generation unit 200 is provided with a human detection sensor, which is not shown in the figure. The human detection sensor detects human entering the mobile terminal booth.

Figure 4:
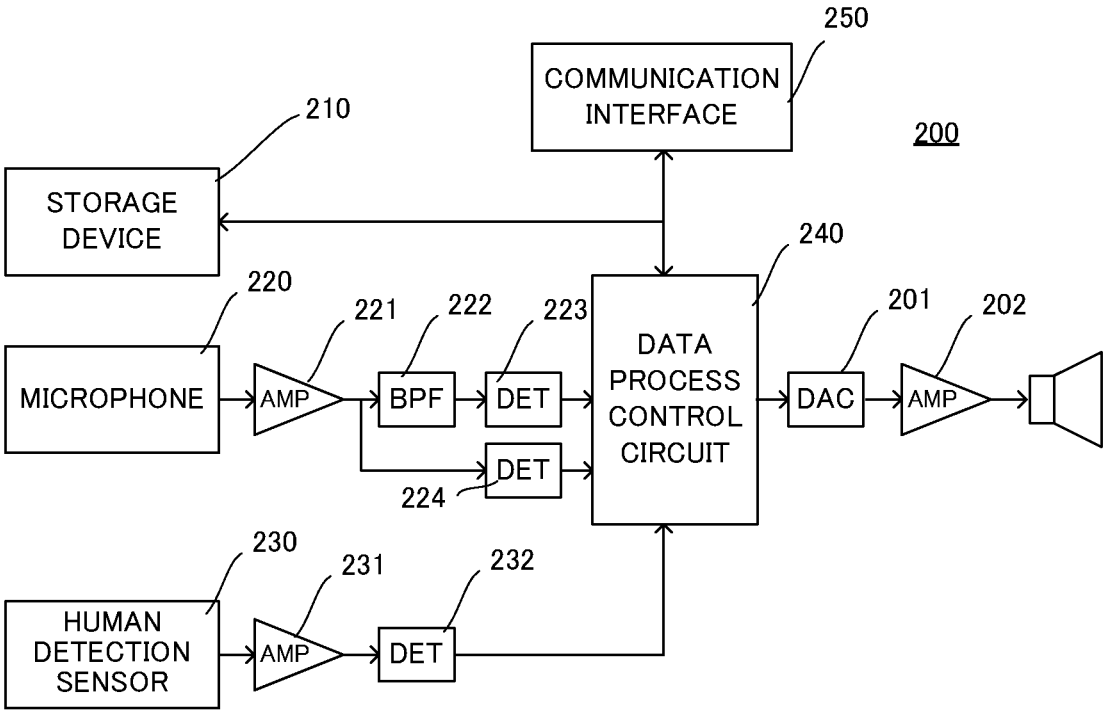
FIG. 4 is a block diagram of a masking sound generation unit installed in the mobile terminal booth shown in FIG. 1.

FIG. 4 is a block diagram of the masking sound generation unit 200 according to the present embodiment. The masking sound generation unit 200 is provided with a storage device 210, a microphone 220, a human detection sensor 230, a data process control circuit 240 and a communication interface 250.

The storage device 210 is implemented, for example, with a micro-SD memory card in which are stored sound sources for generating a masking sound and BGM (Background Music). The microphone 220 is oriented to the inside of this mobile terminal booth to collect sounds inside the mobile terminal booth, for example, the voice of a user during telephone conversation. The human detection sensor 230 is installed on the center of a ceiling of the mobile terminal booth to detect entrance of a user by detecting infrared rays. The data process control circuit 240 generates a masking sound from the speaker 200*s* through a DAC 201 and an amplifier 202 on the basis of signals from the microphone 220 and the human detection sensor 230.

The communication interface 250 is a module for transmitting and receiving data to/from the Internet and controlled by the data process control circuit 240. The communication system of the communication interface 250 includes a public network such as a telephone line, an ISDN line, an ADSL line or an optical line, a dedicated communication line, the third generation (3G) communication system such as WCDMA (registered trademark) and CDMA2000, the fourth generation (4G) communication system such as LTE, the fifth (5G) generation or later communication system, and a wireless communication network such as wifi (registered trademark) or Bluetooth (registered trademark).

The signal output from the microphone 220 is amplified by the amplifier 221, passed through a bandpass filter 222, and detected by a detection circuit 223 which outputs a detection result to the data process control circuit 240. The bandpass filter 222 allows only signals in a high frequency band to pass, for example, to output a large output signal to the detection circuit 223 when the input signal contains a substantially amount of high frequency components, such as a female voice. When the output of the bandpass filter 222 is greater than a predetermined level, the detection circuit 223 outputs a detection signal to the data process control circuit 240. The output of the amplifier 221 is output also to a detection circuit 224. When the input signal contains a smaller amount of high frequency components, such as a male voice, the detection circuit 223 outputs no detection signal. Even in such a case, since the detection circuit 224 outputs a detection signal, the detection circuit 224 serves as a sound presence detection circuit.

The human detection sensor 230 detects infrared radiation inside the mobile terminal booth, and outputs a detection signal when detected. This detection signal is input to and amplified by the amplifier 231, and output to a detection circuit 232. When receiving an input signal above a predetermined level, the detection circuit 232 outputs a detection signal to the data process control circuit 240.

The sound sources stored in the storage device 210 are prepared by the use of raw sound materials which are prepared by mixing natural sounds such as murmurs in crowds containing spoken words with Brownian noise or the like. Particularly, in the case of the present invention, the storage device 210 stores sound sources which are prepared by attenuating high frequency components of such raw sound materials containing natural sounds.

In the case where such sound sources prepared by attenuating high frequency components of raw sound materials containing natural sounds are used as a masking sound, there is the following advantages. Namely, while the masking sound substantially reduces intelligibility of human speech such as telephone conversation, the masking sound it self is only unpleasant noise to other persons than the speaking persons. Particularly, the high frequency components of this noise are harsh-sounding. Since this high frequency components are attenuated in accordance with the present invention, it is possible to lessen the deterioration of the sound environment around the mobile terminal booth due to the masking sound.

Usually, when the high frequency components of the masking sounds are attenuated, the masking effect to the masking target such as human voice is substantially lessened. This is because the high frequency components of the human voice are very important elements for intelligibility of speech contents.

However, the high frequency components of voices are absorbed in the mobile terminal booth so that the sounds leaking from the mobile terminal booth includes high frequency components which are attenuated. Accordingly, even if the high frequency components of the masking sounds are attenuated, the masking effect is maintained.

Specifically, it is known that sounds in this mobile terminal booth are substantially attenuated in a frequency range of no lower than 2 kHz, when heard outside the mobile terminal booth. Accordingly, the raw sound materials as described above are attenuated in a frequency range of no lower than 2 kHz. In addition to this, the higher the frequency, the greater the raw sound materials is attenuated, for example, such as the attenuating amount is gradually increased from 0 dB at 2 kHz to 10 dB at 10 kHz.

Meanwhile, while the storage device 210 stores, as a masking sound, raw sound materials whose high frequency components are attenuated, the present invention is not limited thereto. For example, the masking sound can be obtained by storing raw sound materials containing natural sounds in the storage device 210, and attenuating the high frequency components of the raw sound materials output from the storage device 210.

The masking sounds or the raw sound materials stored in the storage device 210 can readily be updated by downloading new sound data through the communication interface 250 and the Internet. Accordingly, when more an effective masking sound or raw sound material is developed, it can be used immediately. In the case where a masking sound is downloaded through the Internet, the masking sound is generated by attenuating the high frequency component of a raw sound material at the download source.

The masking sound generation unit 200 for the mobile terminal booth having the structure as described above operates as follows. First, when a user enters the mobile terminal booth, the human detection sensor 230 detects the entrance to output a detection signal which is input to the data process control circuit 240. The data process control circuit 240 then has the speaker 200*s* emit a BGM by reading a sound source (BGM) stored in the storage device 210. The reproduction volume of the BGM is gradually increased (fade-in) to a predetermined level from a zero level.

Next, when a user starts telephone conversation, it is determined whether or not the user's voice contains a large amount of high frequency components with reference to the detection signals of the detection circuit 223 and detection circuit 224. In the case where the user's voice does not contain a large amount of high frequency components, such as a male voice, the masking sound is emitted from the speaker 200*s* as it is to overlap the BGM. On the other hand, in the case where the user's voice contains a large amount of high frequency components, such as a female voice, the high frequency components of the masking sound is slightly amplified, and the amplified masking sound is emitted from the speaker 200*s* to overlap the BGM. Namely, as a result in the case of female voices, the high frequency attenuation of the masking sound are made small as compared with the case of male voices. When the user exits the mobile terminal booth and the human detection sensor 230 stops outputting a detection signal, the data process control circuit 240 stops outputting the masking sound and the reproduction volume of BGM is gradually decreased (fade-out) to a zero level.

Figure 5:
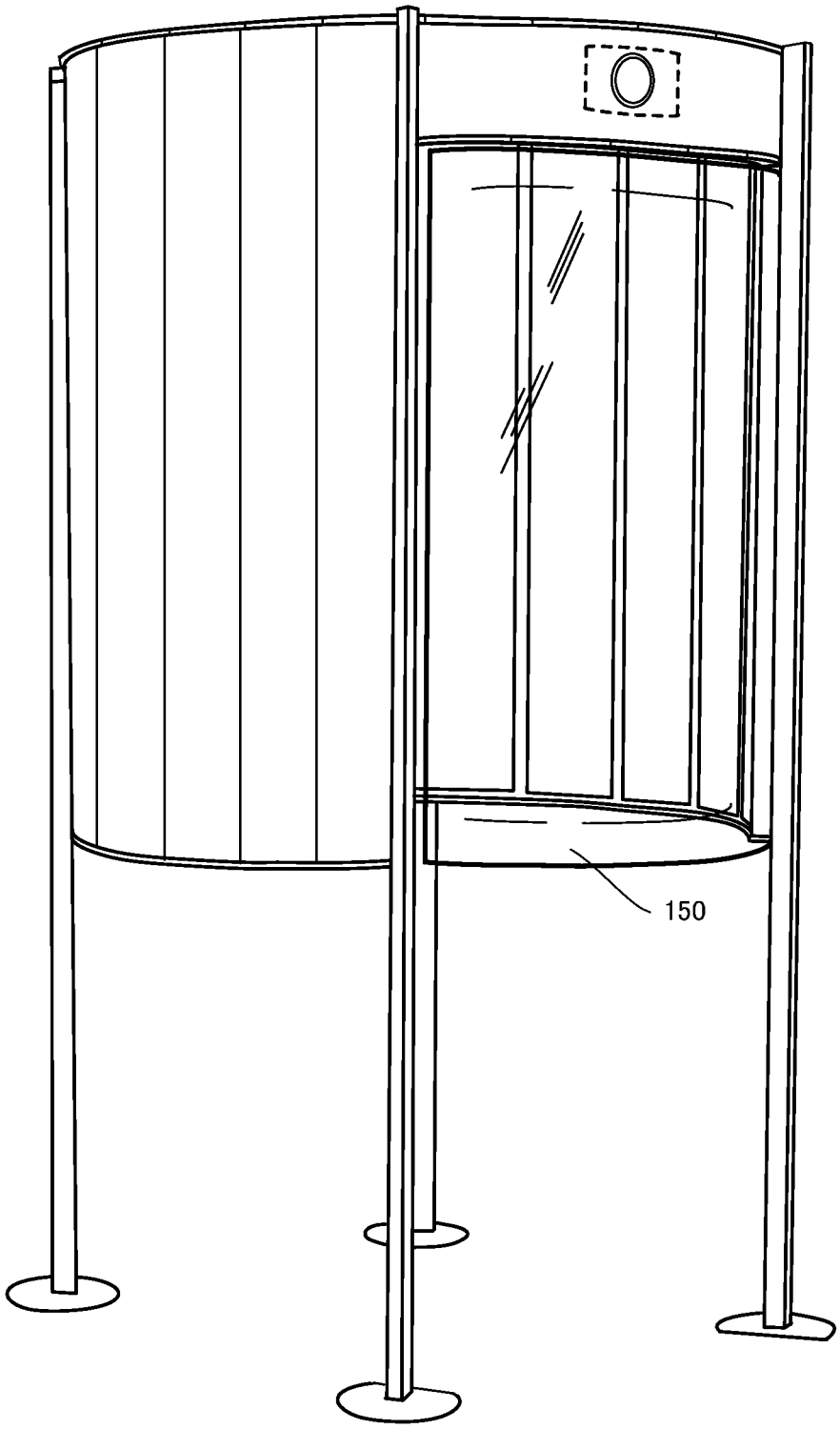
FIG. 5 is a perspective view for showing a mobile terminal booth in accordance with an embodiment of the present invention which is provided with a transparent acrylic door.

The mobile terminal booth of the aforementioned example is designed in the form of a cylinder having an opening in the front side. As illustrated in FIG. 5, a transparent acrylic door 150 can be provided to close this opening. This acrylic door 150 slides in the circumferential direction of the mobile terminal booth along a rail structure provided on the inside of the mobile terminal booth to open or close the opening.

In this case, while the acrylic door 150 occludes the inside of the mobile terminal booth, the transparecy of the door 150 lessens the blocking feeling. The door 150 reduces the volume of voices leaking to the outside. Particularly, the high frequency components of voices leaking to the outside are substantially attenuated. Accordingly, the high frequency components of the masking sound can be more attenuated in accordance with the high frequency attenuation of the leaking voices through the acrylic door 150.

Figure 6:
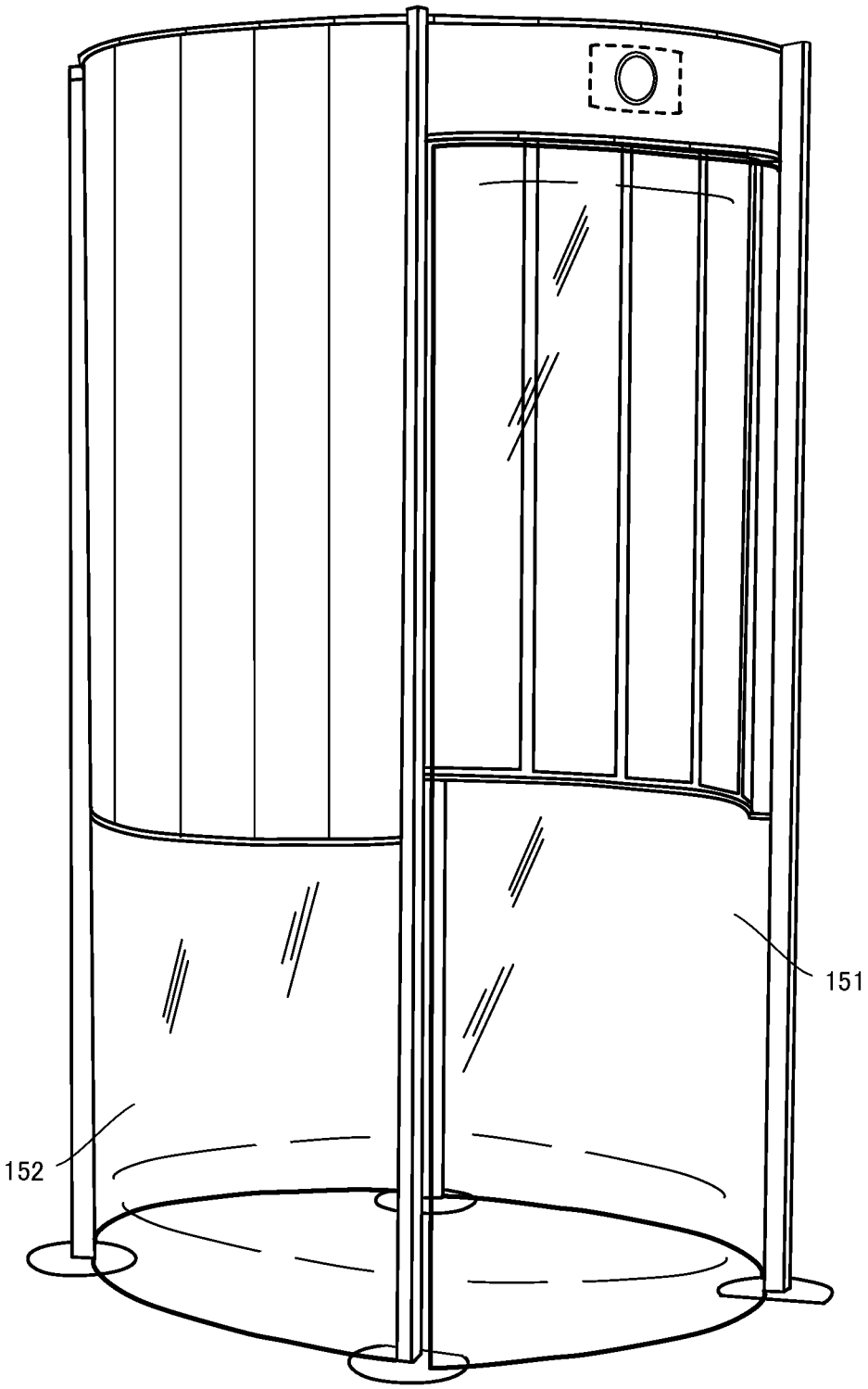
FIG. 6 is a perspective view for showing a mobile terminal booth in accordance with an embodiment of the present invention which is provided with another type of a transparent acrylic door.

The acrylic door 150 as shown in FIG. 5 is supported with its lower edge which are positioned 90 cm above from the floor in the same manner as the plate-like sound absorbing panel 111. Accordingly, the section of a user above the waist is surrounded by the plate-like sound absorbing panel 111 and the acrylic door 150. On the other hand, the lower part of the mobile terminal booth below the waist, i.e., the space from the floor to 90 cm height is opened. However, the lower part of the mobile terminal booth can be closed to enhance the sealability of the inside space. Namely, the acrylic door 150 shown in FIG. 5 is extended downward to the floor to completely cover the front side as an acrylic door 151 illustrated in FIG. 6. In addition to this, a transparent acrylic panel 152 is installed to cover the lower part of the mobile terminal booth from the lower edge of the plate-like sound absorbing panel 111 to the floor. By this configuration, the internal space of the mobile terminal booth is completely sealed so that voices leaking outside becomes more small to further attenuate the high frequency components of the voices leaking outside. Accordingly, the high frequency components of the masking sound can be more attenuated by the high frequency attenuation of the leaking voices through the transparent acrylic door 150 and the transparent acrylic panel 152.

Figure 7:
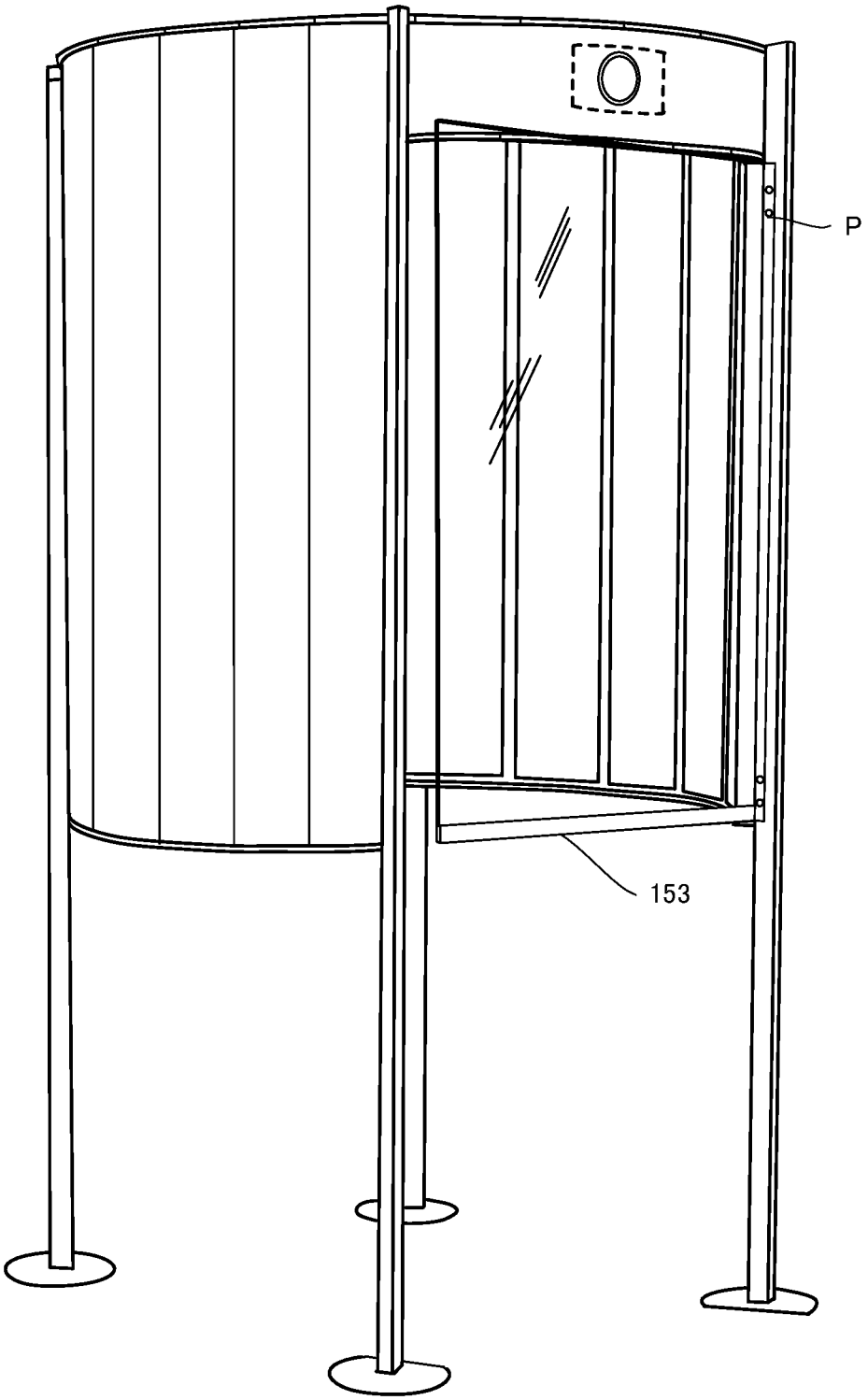
FIG. 7 is a perspective view for showing a mobile terminal booth in accordance with an embodiment of the present invention which is provided with a further type of a transparent acrylic door.

Meanwhile, the acrylic door 150 slides in the circumferential direction of the mobile terminal booth along a rail structure provided on the inside of the mobile terminal booth to open or close the opening. This structure prevents the transparent acrylic door 150 from getting in the way to realize barrier-free. However, a usual hinged door can be used in place of the slide door such as a transparent acrylic door 153 which pivots around a hinge P as illustrated in FIG. 7.

The mobile terminal booth according to the present invention is provided with the masking sound generation unit so that, when telephone conversation is made in the mobile terminal booth, the content of conversation is inaudible for persons outside the mobile terminal booth. Accordingly, it is possible to protect speech privacy. Also, since the masking sound generation unit emits a masking sound whose harsh-sounding high frequency components are attenuated, the masking sound gives less uncomfortable feeling to persons surrounding the mobile terminal booth. Furthermore, also for the user having telephone conversation in the mobile terminal booth, the masking sound is relatively not so harsh-sounding. As a result, it is possible to promote the use of the mobile terminal booth.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A mobile terminal booth with a sound masking function comprising:

a sound absorbing panel which partitions a space as viewed from the above to provide a place where a user of a mobile terminal can have a telephone conversation;

a speaker provided to emit sounds to an outside of the mobile terminal booth; and a masking sound generation unit provided to emit a masking sound through the speaker, wherein a high frequency component of the masking sound is attenuated.

2. The mobile terminal booth of claim 1, wherein the masking sound is generated by attenuating a high frequency component of a raw sound material including a natural sound.

3. The mobile terminal booth of claim 1, further comprising a human detection sensor which detects a user entering the mobile terminal booth, wherein when the human detection sensor detects a user entering the mobile terminal booth, the masking sound is emitted from the speaker.

4. The mobile terminal booth of claim 3, wherein when the human detection sensor detects a user entering the mobile terminal booth, a background music (BGM) is emitted from the speaker, and then the masking sound is emitted from the speaker to overlap the BGM.

* * * * *